US009346523B2

(12) United States Patent
Rochfort

(10) Patent No.: US 9,346,523 B2
(45) Date of Patent: May 24, 2016

(54) BARGE SYSTEM

(71) Applicant: William P. Rochfort, Fitzgerald, GA (US)

(72) Inventor: William P. Rochfort, Fitzgerald, GA (US)

( * ) Notice: Subject to any disclaimer, the term of this patent is extended or adjusted under 35 U.S.C. 154(b) by 190 days.

(21) Appl. No.: 14/248,974

(22) Filed: Apr. 9, 2014

(65) Prior Publication Data

US 2014/0299033 A1 Oct. 9, 2014

Related U.S. Application Data

(60) Provisional application No. 61/810,252, filed on Apr. 9, 2013.

(51) Int. Cl.

| | |
|---|---|
| ***B63B 35/28*** | (2006.01) |
| ***B63B 35/38*** | (2006.01) |
| ***B63B 3/08*** | (2006.01) |

(52) U.S. Cl.

CPC . *B63B 35/28* (2013.01); *B63B 3/08* (2013.01); *B63B 35/38* (2013.01); *Y10T 29/49826* (2015.01)

(58) Field of Classification Search

CPC ..... B63B 3/08; B63B 21/56; B63B 21/62; B63B 35/28; B63B 35/34; B63B 35/38

USPC ..... 114/26–28, 31, 77 R, 77 A, 249–252, 114/263, 266, 267; 14/2.6, 27

See application file for complete search history.

(56) References Cited

U.S. PATENT DOCUMENTS

| | | | | |
|---|---|---|---|---|
| 4,060,048 | A * | 11/1977 | Breheret | E02B 3/064 114/249 |
| 4,714,042 | A * | 12/1987 | Schulte | B63B 35/38 114/249 |
| 6,748,892 | B1 * | 6/2004 | Rochfort | B63B 3/06 114/266 |
| 8,166,902 | B2 * | 5/2012 | Rochfort | B63B 3/08 114/249 |

* cited by examiner

*Primary Examiner* — Ajay Vasudeva
(74) *Attorney, Agent, or Firm* — Brian D. Bellamy

(57) ABSTRACT

An improved barge system comprises a barge with a connecting system built into the barge. The connecting system includes several recessed areas about the periphery of the barge with upper and lower rails about the peripheral edges of the barge. A vertical post having a lower connecting member and an upper connecting member is attached within the recessed area for rotation into position to connect the upper and lower connecting members to adjacent upper and lower rails on the adjacent barges. Wedge blocks attached outwardly on adjacent rails each receive a wedge in the gap between the respective wedge block and a connecting member. Spacer blocks improve parallel alignment of the connected barges.

11 Claims, 7 Drawing Sheets

BARGE SYSTEM

PRIORITY CLAIM

The present application claims priority of U.S. provisional patent application Ser. No. 61/810,252 filed on Apr. 9, 2013, entitled "Barge System" by William P. Rochfort.

BACKGROUND OF THE INVENTION

1. Field of the Invention

The present invention relates to improved truckable water born barge systems and more particularly pertains to securing a plurality of barges with high efficiency connectors and improved load absorption and distribution.

2. Description of the Prior Art

The use of connectable barges of certain designs and configurations is discussed in the art. For example, U.S. Pat. No. 6,748,892 to Rochfort disclosed a barge system having a plurality of barges arranged in rectilinear configuration and connected. Each barge included plates to define an upper periphery and a lower periphery. Rails were provided around the upper and lower peripheries, and a plurality of vertically disposed recesses was formed in side, front and rear plates. A plurality of connectors was provided with each connector including a post and upper and lower ends. The lower ends included a downwardly facing inverted U-shaped member with a first portion of the lower end positioned upon a lower rail of one barge and a laterally disposed second portion positioned upon an adjacent lower rail of an adjacent barge. An upwardly facing U-shaped member on upper ends each were given a first portion positioned to receive an upper rail of one barge, and a laterally disposed second portion positioned to receive an adjacent upper rail of an adjacent barge. The barge system taught by Rochfort in '892 provided barge sections that are capable of being hauled to location by a truck and then being coupled together.

Rochfort further improved upon a truckable barge system in U.S. Pat. No. 8,166,902. The '902 patent disclosed a barge system with separated hinged upper and lower connecting members within a recess for rotation into position to connect an adjacent barge by connecting the upper and lower connecting members to adjacent upper and lower rails on the adjacent barges. An adjustable hinge and wedged lower end of the connecting member was provided for alignment of the upper connecting member with the vertical post.

While the '902 barge system improved the quality of the truckable barge system, it has been recognized that a continuing need exists for a new and further improved barge system that can be used more cost efficiently with smaller loads, while retaining the advantages of convenient and individually truckable barges. In this regard, the present invention provides improvements to reduce the number of connectors needs for lighter loads.

SUMMARY OF THE INVENTION

The present improved barge system design allows barge sections to be connected together for hauling lighter loads with fewer connectors than previously known. In particular, at least one connector may be eliminated from each pairing of rails of adjacent barge sections. Only one connector is required for each pairing of adjacent pockets. As the connectors are a robust member constructed of very strong materials with exact engineering specifications, reducing the number needed significantly reduces the cost of the barge for lighter loads, for example tractors instead of cranes.

In a barge system like that taught in the invention, a pair of barge sections is aligned beside each other. The barge sections include rails located within pockets. Adjacent rails and pockets of the barge sections are aligned, whereby connectors within the pockets connect the barge sections by engaging the rails. The improved barge system uses a combination of wedge blocks, rails and wedges on one end of a pocket to secure the rails on the reference end of the pocket. The wedges secure the rails of the system with reference to both an end of the pocket and the sides of the pockets, which eliminates the requirement for a second connector on an opposing end of the pocket.

In the prior design in U.S. Pat. No. 8,166,902, the barge system secured the rails by pushing a center wedge between the rails, which with only one end done would not keep the opposing end of the rails aligned and secured. This method was found costly compared to the need for some applications, in particular with respect to lighter loads that did not require such a robust connection. The present improvements eliminate the need for a center wedge between the rails as previously required by the prior design. The connector used in the pocket of the present improved system includes sloping sides. Instead of a center wedge, wedge blocks are attached to both the rails and the barge wall. Wedges insert on the outside of the rails between the wedge blocks to secure the rails on the reference end of the pocket.

The barge sections are forced together and aligned in exact parallel alignment in the present design by pushing spacer blocks together. The spacer blocks, or alignment blocks, of different thicknesses are required along sides and the end of the barges, top and bottom next to pockets, adjacent to rails, to take up any misalignment caused by welding warp etc. The parallel alignment of the barges permits connecting multiple barges to each other.

In view of the foregoing, an object of the present invention is to provide a more efficient system for coupling barges, especially for lighter loads. In particular, the present invention provides a connection system in which fewer connecting parts are needed to connect separate barge sections.

Another object is to make the system self-aligning using fewer connectors so as to reduce manual labor and strain in aligning and connecting adjacent barges.

And yet another object is to reinforce the strength and security of the connection between coupled barges by self-alignment and securely wedging the connecting members into tightly fitting close relationship.

DETAILED DESCRIPTION OF THE INVENTION

With reference to the illustrations, the preferred embodiment of the new and improved barge system embodying the principles and concepts of the present invention will be described. In the present invention, the barge system is comprised of a plurality of previously described components illustrated in the prior barge system 110 of FIG. 12, now improved as illustrated in the remaining figures. Such components in their broadest context include individual barges, rails, a plurality of vertically disposed recesses on the periphery of the each barge, and a plurality of connectors. A present system includes a plurality of barges provided in rectilinear configuration. A group or cluster of the barges can be placed together and connected, whereby each barge 112 is a barge section forming a larger barge when the system is used to combine the plurality of barges as described.

Figure 12:
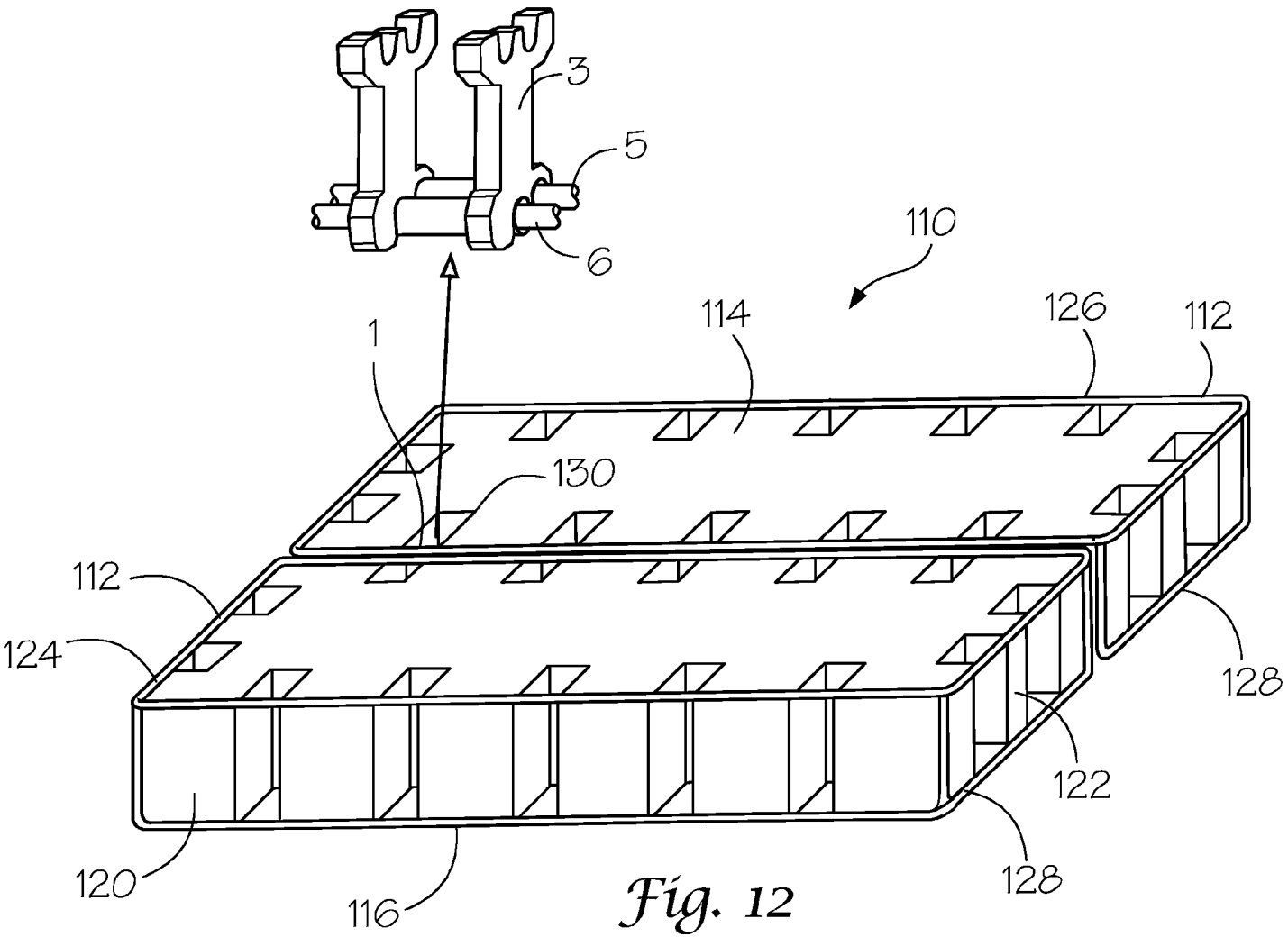
Fig. 12 PRIOR ART
FIG. 12 is a prior art barge connection system without improvements.
Figure 13:
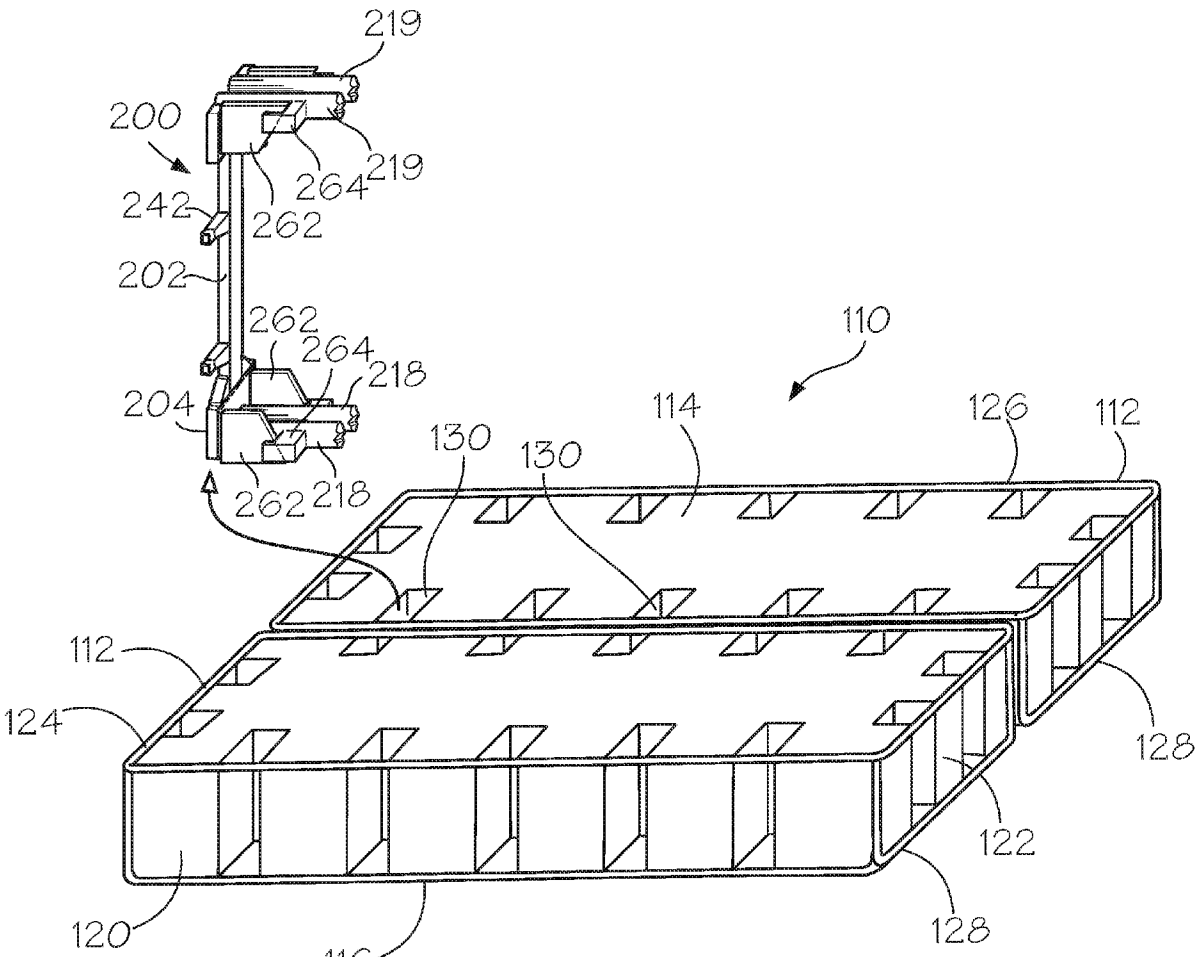
FIG. 13 is a perspective view of a barge connection system in accordance with the present invention in which the connection system is shown in a perspective assembly in relation to the pocket created between adjacent barge sections.

As shown in FIG. 12, each barge 112 has a horizontal rectilinear upper plate 114 and a parallel lower plate 116. The horizontal plates have long parallel side edges and short parallel front and rear edges. Each barge also has a pair of vertical parallel side plates 120 and vertical parallel front and rear plates 122, 124. The vertical plates have upper edges, and rails 126 are attached at the upper edges near the upper plate about the periphery of the barge. In this manner an upper periphery is defined. The vertical plates have lower edges, and rails 128 are attached at the lower edges near the lower plate. In this manner, the lower periphery is defined.

A plurality of vertically disposed recesses 130 is provided. The recesses are formed in the vertical plates and the upper and lower plates. The recesses constitute pockets inwardly beyond the rails. The recesses all have a common height equal to the height of the barge. The recesses 130 each include an inside wall and opposing end walls, with the outer side open and exposing the recessed area that forms a pocket in combination with an adjacent barge 112.

Figure 1:
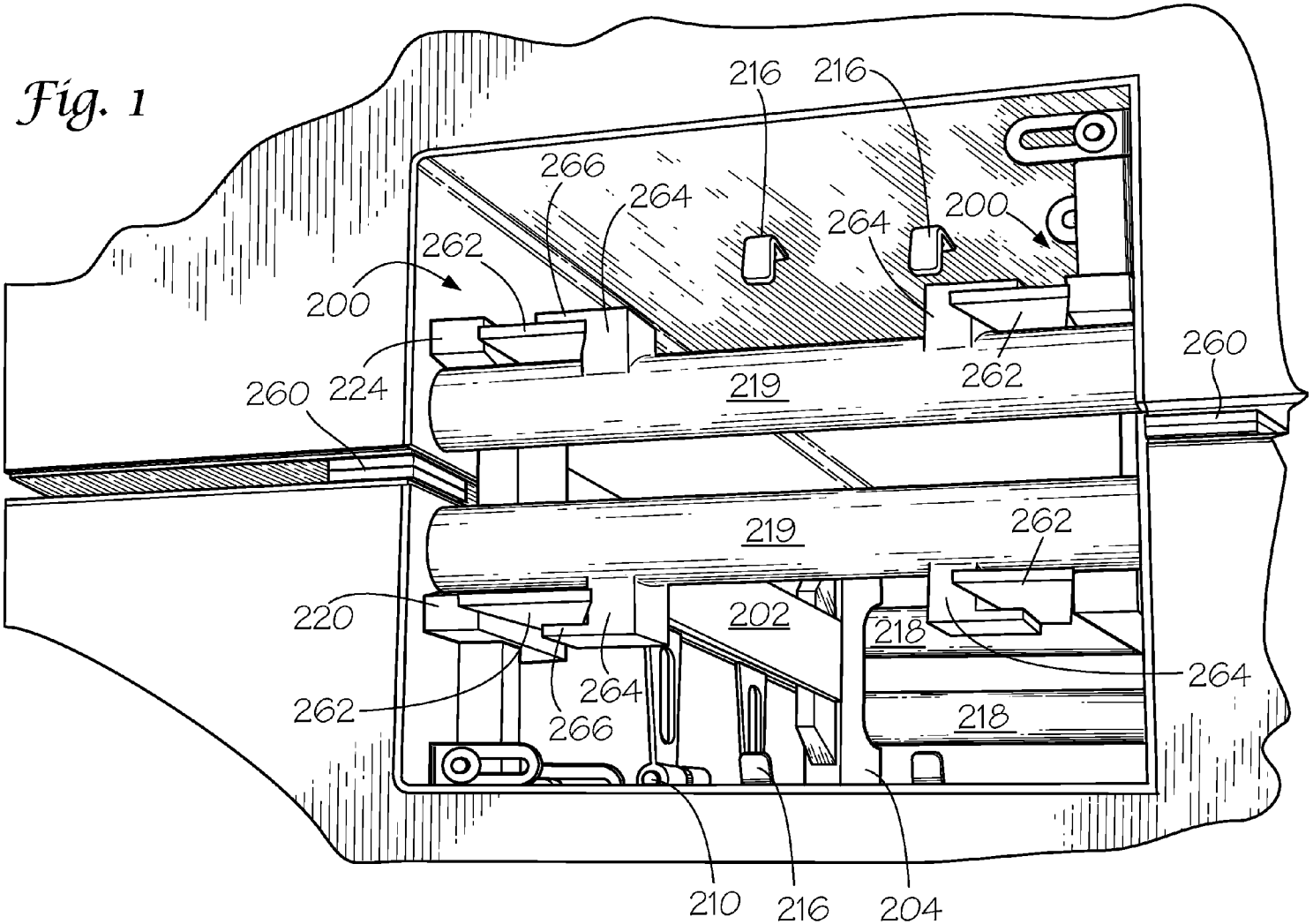
FIG. 1 is a top perspective view of a connector system for a barge.

As shown in FIG. 1, connectors 200 are provided in the recesses. Each connector includes a rectilinear vertical post 202 and may include a lower connector member 204 where some additional reinforcement is needed. However, the present improvements may allow for the elimination of the lower connector members when the load demands are not too great. The vertical post has an upper end and lower end. The lower end of the vertical post may include the downwardly facing U-shaped lower connector member 204 having a downwardly arched portion with members 206, 208 on each side of the arch. When two connectors are used in the present barge system, the vertical post is positioned and attached in adjacent recesses on opposing barges 112 and positioned in the adjacent recesses in opposite corners from one another. A single connector attached in an adjacent recess on a single reference end of the recess may be used, which is sufficient for light loads using the present improved system. Nonetheless, two diagonally opposed connectors as described above may be used in circumstances requiring more reinforcement, while still utilizing the methods and improvements set forth by the embodiments discussed herein.

The vertical post pivotally rotates on an elongate axis shaft 210 that is attached to an end wall or the inside wall of the recess. The axis shaft includes a rod 212 extending through a cylindrical bracket 214. The rod lifts within the bracket to operate the rotatable vertical post 202. The vertical post is held on a hook 216, lifted upward, rotated into position above adjacent lower rails 218 of adjacent barges, and lowered onto or above the adjacent lower rails to connect the barges. In the case that a lower connector member 204 is provided on the lower end of the vertical post 202, the arched portion with members 206, 208 is positioned upon a lower rail of each adjacent barge for coupling the barges 112.

Each connector includes an upwardly facing U-shaped upper connector member 220 having an upwardly arched portion with members 222, 224 on each side of the arch. When two connectors are used in the present barge system, the upper connector member 220 is positioned and attached in adjacent recesses on opposing barges 112 and positioned in the adjacent recesses 130 in diagonally opposite corners. Only one upper connector member may be needed for lighter loads, and may be attached on the reference end of the adjacent recesses, whereby the present improvements provide for three of the four U-shaped connector members previously required in the prior art to be eliminated in certain applications where such additional reinforcement is not needed. In many situations at least one vertical post and related connector members can be eliminated reducing the cost of providing such connectors and reducing the time required to connect adjacent barges.

The upper connector member 220 is attached to an upper axis shaft 226 situated above the vertical post 202. The upper axis shaft is attached to the end wall or near the end wall on the inside wall of the recess. The upper connector member pivotally rotates on the upper axis shaft via a hinge 228 comprised of rod 230 that extends through a bracket 232. The upper connector 220 may be connected to the rod by an extendable linkage 234. Thereby, the linkage and brackets provide horizontal flexibility to enable alignment of the upper connector member 220 with the vertical post 202 and alignment of the upwardly arched portions 222, 224 under the upper rails 219. The flexibility provided by the linkage and brackets will not be needed in most applications of the improved system provided herein, as spacer blocks 260 between the rails of adjacent barge sections will provide similar functions and allow for a less expensive connection.

The upper connector member 220 retracts downward on the hinge and rotates into position below the upper rails 219 and above and separated from the vertical post 202. The upper connector member 220 may include a lower end with an angular edge forming a wedge member 236. The horizontal flexibility of the linkage and bracket permits the upper connector wedge member 236 to move into adjacent aligned relation to the top end of the vertical post.

The upper connector member 220 is moved securely into place above the vertical post and below the upper rails 219. As the upper connector member is moved into place, the upper connector wedge member 236 tightens the upper connector member and tightens the connection between the adjacent barges 112.

A set of two wedges 262 are provided for use with each upper and lower connector member on each connector used to secure the rails to connect barge sections. In the embodiment illustrated, each wedge is a quadrilateral plate having an exterior angle formed by two adjacent sides providing a gradual slope and the quadrilateral having a first narrow end and a second wide end, whereby the wedge is received from the narrow end. The wedges 262 are used for securing the rails 218, 219 to the related upper or lower connector member 220, 204, thereby securing the barges 112 to each other. In particular, each upper or lower connector member provides a face with a receiving surface for receiving one side of each wedge 262. The face of the connector member receiving surface receiving the wedge may be tapered to receive the wedge more securely there against the connector member. Each wedge is inserted between a face of the respective connector member receiving surface and a receiving surface of a wedge block 264. More particularly, each wedge is positioned between the respective receiving surface of the connector member and the receiving surface of the respective wedge block 264 attached to the respective rail, and each wedge 262 is positioned within a recess and gap between the opposing connector member and the wedge block. Each wedge is in forced into contact with the opposing receiving surfaces at each end and edge of the wedge with one edge of the wedge bearing against the receiving surface of the upper connector member, and the opposite edge of the wedge bearing against the receiving surface of the wedge block 264. In this manner the wedge and the wedge block combination precludes axial displacement of the connector member along the rails. When driven in between the connector member and wedge block, the wedge also adds rigidness and stability to the connection of the barges.

The wedge blocks 264 are attached to the rails as discussed above and may be welded to the side of the rail. Each wedge block extends laterally and outwardly from the side of the rail. The wedge block includes a strong and rigid block member with interior surface for receiving the respective wedge. The block further includes a flange on the opposite end from the attachment to the rail. The flange extends perpendicular to the block and toward the opposing connector member when the connector member is secured to adjacent rails. A wedge is held in place between the receiving surface of the connector member and the receiving surface of the wedge block 264 by the flange 266 on the wedge block. The receiving surface of the wedge block 264 is tapered from top to bottom such that the distance between the receiving surfaces of the wedge block and connector member narrows from top to bottom. Therefore, as the wedge is inserted further, the connection between the receiving surfaces of the respective connector member 220, 204 and wedge block 264 tightens. The wedges 262 displace and apply force by drawing the rails 218, 219 toward one another and toward the ends of the pockets between the barge sections 112. This direction of forces allows only one connector member to create a tight connection between adjacent rails of adjacent barge sections, whereby neither end of a connection of rails will tend to separate. Therefore, for lighter loads, a connector on one end of the pocket can be eliminated.

The connector members where the wedges are inserted may include a lip 268 to assist in retaining the wedge between the connector member and wedge block while the wedge is inserted. The lip will prevent lateral movement or slipping, similar to the flange 266 on the wedge block 264. As mentioned, the receiving surface of the connector member may be tapered like the surface of the wedge block to further improve the mechanics and connection of the wedge. When the wedge is fully inserted, the connector member will bear against the inner wall of the barge recess, whereby the barge is secured to the connector in position.

The position and proper alignment of the barge sections in the system will be regulated by spacer blocks that are attached to the adjacent barges. The force of application of the wedge with respect to connection will force the barge section together. The barge sections will be aligned in exact parallel alignment in the present design by pushing abutting spacer blocks on opposing adjacent barges together. The spacer blocks, or alignment blocks, of different thicknesses are situated along sides and the ends of the barges. The spacer blocks are situated near both the top and bottom near adjacent recesses of barges that form the pockets between the barges. Spacer blocks 260 at the top of a barge near adjacent recesses are shown in FIG. 1 at opposing ends of the pocket situated on the wall of each barge and abutting as discussed. Spacer blocks are further depicted in FIG. 9 at both the top and bottom of abutting barges. As force is applied by the wedges 262, the spacer blocks take up any misalignment caused by welding warp or other barge defects. The parallel alignment of the barges permits connecting multiple barges to each other.

Figure 2:
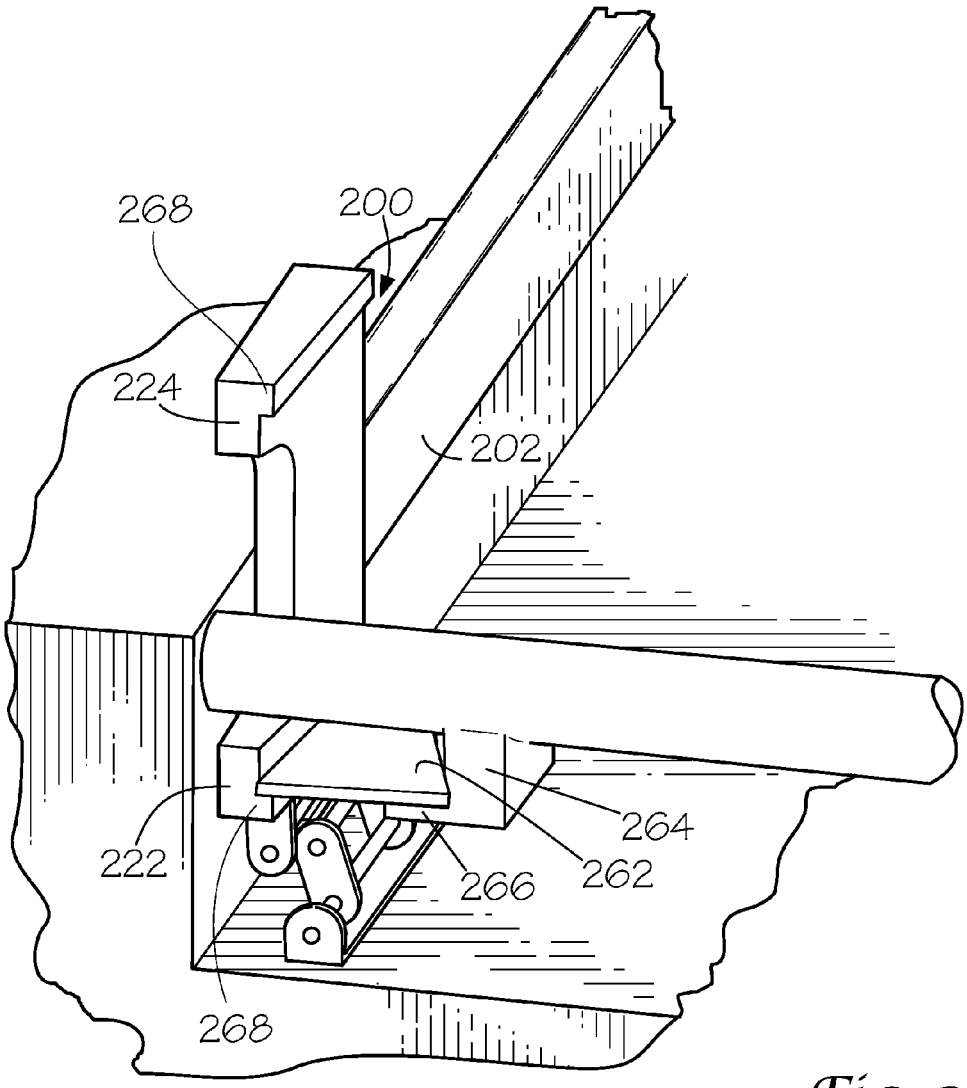
FIG. 2 is a top perspective view of a portion of a barge pocket including a portion of the connector system in accordance with the invention.

As shown in FIG. 2 showing the right hand corner of a barge pocket, the connector system for the barges includes an upper connector area. A portion of the vertical post 202 is shown for reference. The upper connector area includes the upper connector member 200. FIGS. 3-8 illustrate the upper axis shaft 226, hinge 228, and the extendable linkage 234. The extendable linkage proves means to link the upper connector member via the hinge that is attached to the inside wall of the recessed pocket. The length of the hinge allows the upper connecting member to be raised and lowered to pass under the peripheral rail (upper rail) of the barge. The upper connecting member is then raised over the top of the vertical post of the lower connector system while maintaining a level plan for the whole upper connector system. Further, as it swings out from its captive position against the inner wall of the recessed pocket, there is attached to the hinge a three part extendable linkage that is shorter than the length of the hinge post or rod. The extendable linkage allows for longitudinal travel of the upper connection member so that the upper connection member (or locking plate) can be self centering as it captures the upper rail (or rail) as shown and the upper rail (or rail) of an adjacent barge.

Figures 3, 4, 5, 6, 7, 8:
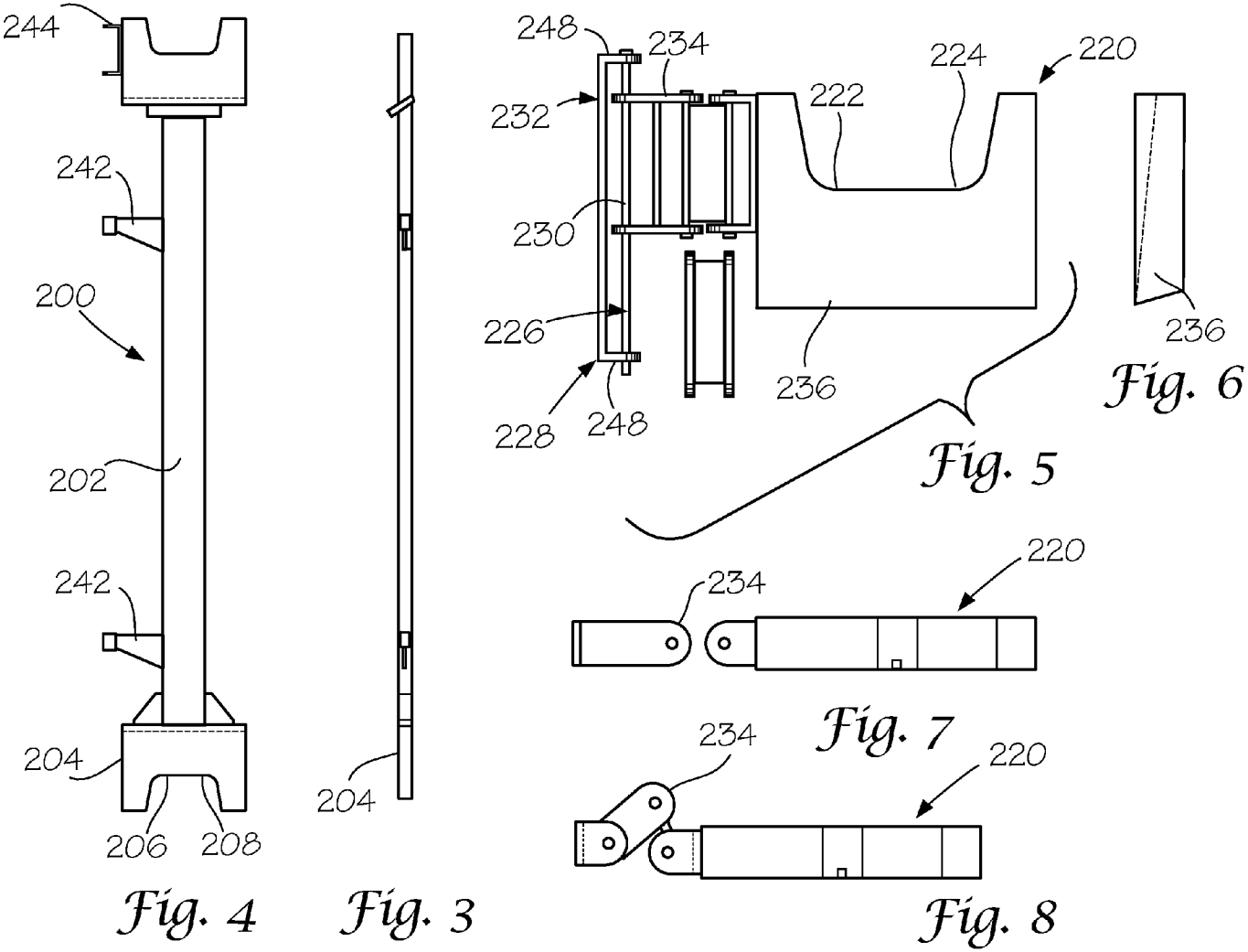
FIG. 3 is a side plan view of connectors of the invention.
FIG. 4 is a front plan view of the connectors.
FIG. 5 is front plan view of a connector, hinge and link of the invention.
FIG. 6 is a side plan view of the connector of FIG. 5.
FIG. 7 is a top plan view of the connector, hinge and link of FIG. 5.
FIG. 8 is an alternate top plan view of the connector, hinge and link of FIG. 5.

FIG. 3 shows the arrangement of features within each recessed pocket to store and capture the connector system inside of each pocket in each barge. FIG. 3 shows a left side view of upper and lower connecting members (or locking plates) with the vertical post attached to the lower connecting member. Collectively, the connecting members and vertical post features are referred to as a connector system. As a subset, there is an upper connector system including the upper connector member, and a lower connector system including the lower connector member.

FIG. 4 shows a pair of pivot arms 242 attached to the vertical post and a pivot bracket 244 attached to the upper connector member (or top locking plate). As shown in FIG. 5, the pivot arms 248 of the hinge that attaches to the back of the pocket have a large diameter hole to accept the axial shaft having a smaller diameter (¾ inch shaft vs. 1¼ inch hole). FIG. 6 shows a side view of the upper connector member, and FIGS. 7-8 showing the extendable linkage in alternate positions, extended and retracted. The extendable linkage allows the upper connecting member to move longitudinally for self-adjustment of the upper connecting member on the upper rails 219, and the upper axis shaft allows the upper connecting member to move latitudinal for self-adjustment.

Figure 9:
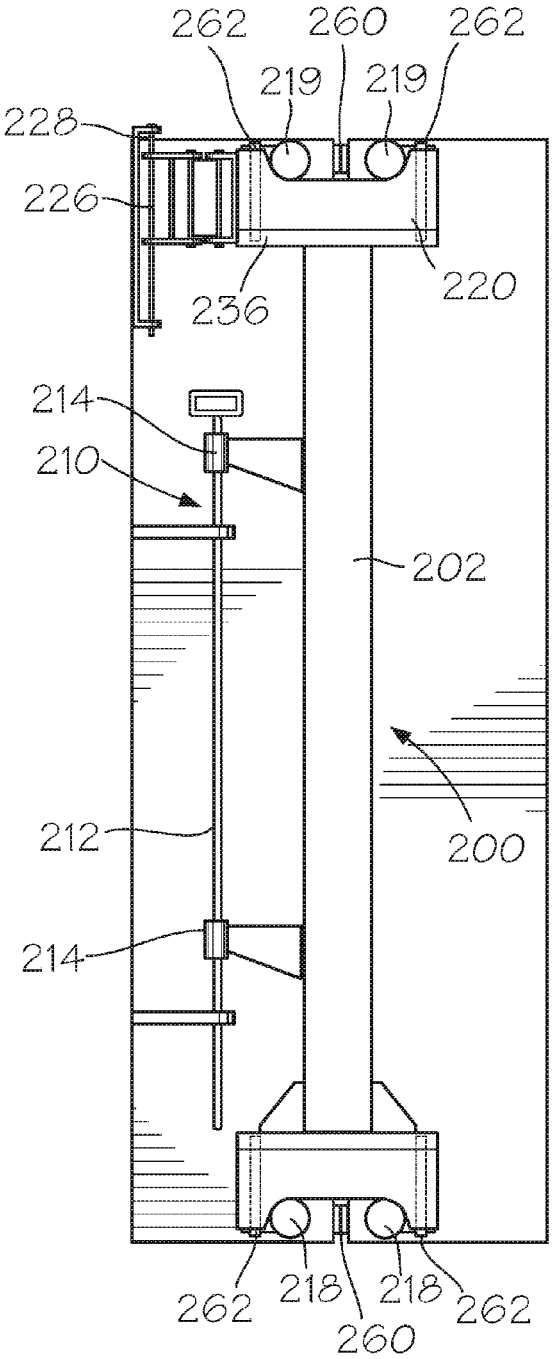
FIG. 9 is a cross-sectional end plan view of a recess of a barge with a connector system coupling a barge with an adjacent barge via upper and lower rails.
Figure 10:
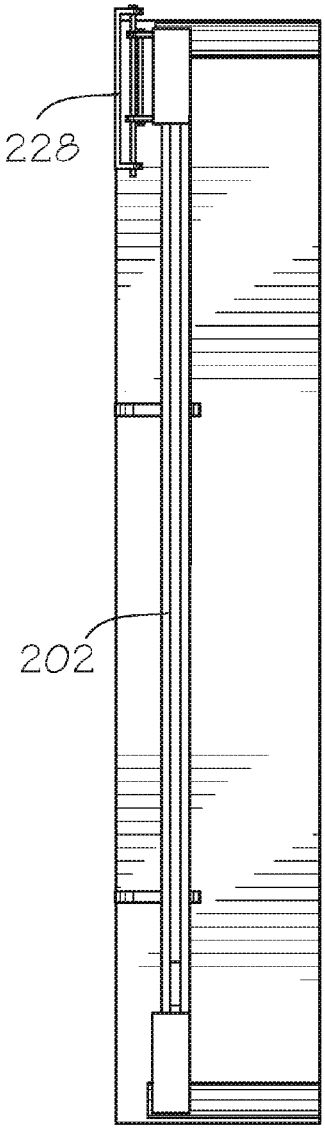
FIG. 10 is a side plan view of a recess as in FIG. 9 with the connector system in coupling a barge as in FIG. 9.

FIG. 9 illustrates the connecting system in place as it is when connected to two sets of adjacent rails. The connecting system parts rotate back inward to a storage position against the inside wall of the recessed pocket for storage as shown in FIG. 10.

Figure 11A:
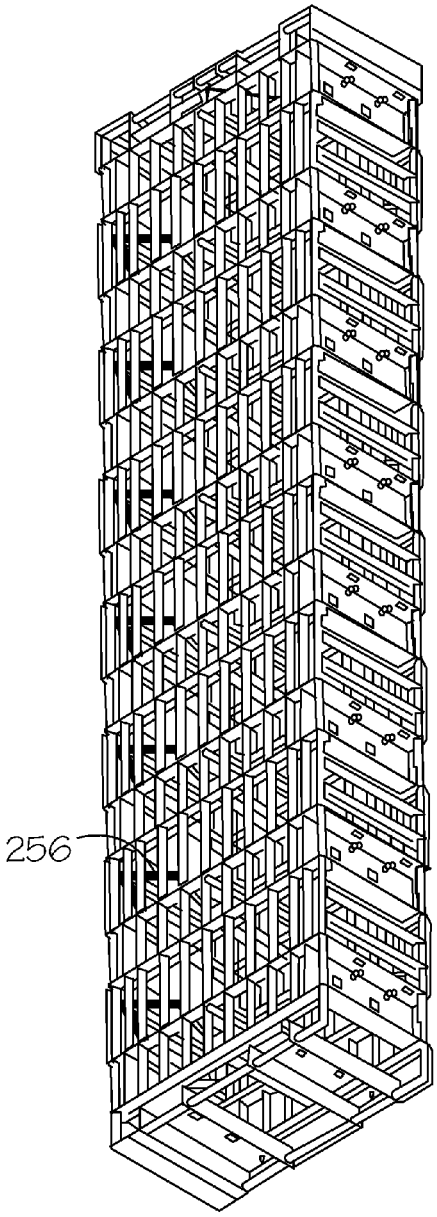
FIG. 11A is a perspective view of the torsion bar system in accordance with the invention.
Figure 11B:
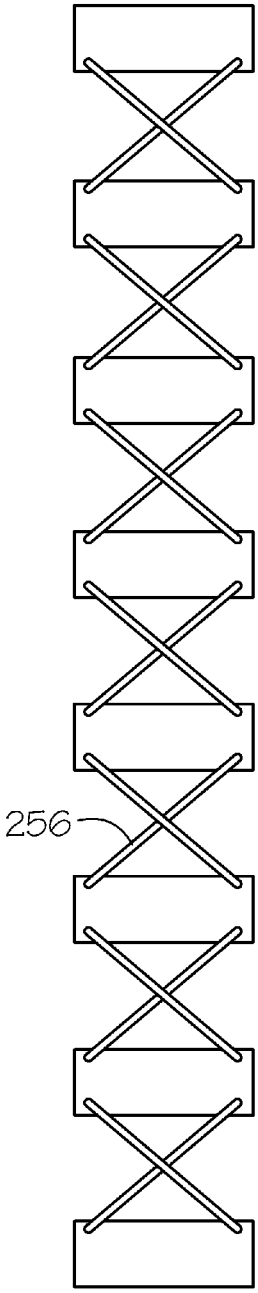
FIG. 11B is a plan view of the inside of the barge illustrating the torsion bar system of FIG. 11A.
Figure 11C:
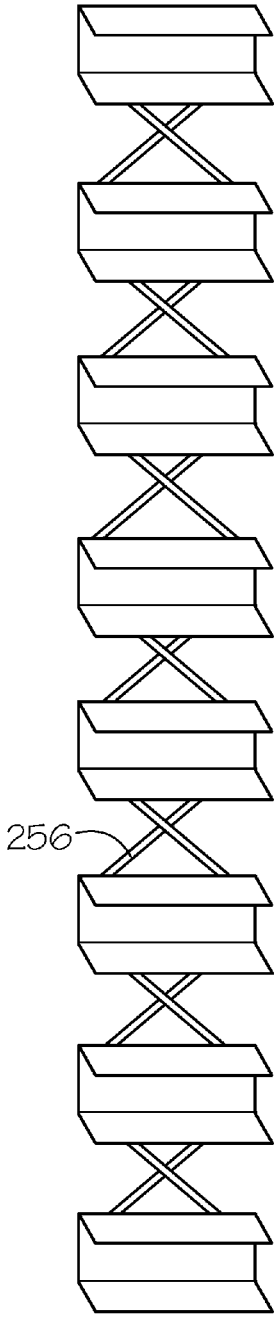
FIG. 11C is a perspective fragmentary view of the outside of the barge illustrating the torsion bar system of FIG. 11A.

The torsion bars 256 shown in FIGS. 11A-11C provide a system for controlling twisting and any ambiguity due to stress or heat distortion which interferes with connecting barges together. As shown, the torsion bars are attached in crossed relation on the back side of the inside wall of each recess.

FIG. 12 illustrates the previous barge system using connectors have a W-shaped upper connector member and an M-shaped lower connector member. These members worked in combination with a wedge 262 inserted between the rails that would force the rails outwardly against the connector members. This previous barge system physically required using two connectors on opposing ends of the recess between barge sections. This prior system provides a robust solution for heavy loads. However, this prior system is not as cost effective and the barge system described herein with respect to lighter loads. The barge system described herein eliminates the requirement for using two connectors and saves costs and time when hauling lighter loads with a barge system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A barge system comprising:

at least a first barge and a second barge, each barge having a rectilinear configuration with upper and lower plates and a pair of side plates and front and rear plates to define an upper periphery and a lower periphery;

a plurality of recesses about the side plates of each barge, the recesses each having a rail, whereby the first barge is situated adjacent to the second barge providing adjacent rails and is connected to the second barge with the adjacent rails being situated for connection;

a plurality of connectors with at least one connector pivotally attached to an inner wall of the recesses of the adjacent barges for coupling the barges together, the connector coupling the adjacent barges by engagement of the adjacent rails to a connection member of the connector, and each connector including at least one connection member having a wedge receiving surface;

the adjacent rails within the recesses include a first wedge block attached on a first one of the adjacent rails and a second wedge block attached on a second one of the adjacent rails, each wedge block being disposed outwardly from a common parallel center on opposite outward sides of the respective rails, and each wedge block including a wedge receiving surface; and a wedge received on each of the opposite outward sides of the respective rails between the wedge block and the at least one connection member when the connector is coupling the adjacent barges, whereby the wedge forcefully engages against the wedge receiving surface of the wedge block and the wedge receiving surface of the connection member for connection of the barges.

2. A barge system as in claim 1 in which said wedge is a quadrilateral plate having an exterior angle formed by two adjacent sides providing a gradual slope and the quadrilateral having a first narrow end and a second wide end, whereby the wedge is received from the narrow end.

3. A barge system as in claim 2 in which the wedge receiving surface of each wedge block is sloped.

4. A barge system as in claim 2 in which the wedge receiving surface of each connection member is sloped.

5. A barge system as in claim 1 in which said connection member bears against the barge within the recess when the wedges are inserted.

6. A barge system as in claim 1 in which each wedge block is welded to the sides of the respective rail and includes a flange on the outer edge of the wedge block extending perpendicular to the wedge receiving surface of the wedge block, whereby the flange retains the wedge between the wedge block and the connection member when the wedge is inserted.

7. A barge system as in claim 6 in which the connection member with wedge receiving surface includes outer edges on the wedge receiving surface and includes a lip on each outer edge of the wedge receiving surface for retaining the wedge between the wedge block and the connection member when the wedge is inserted.

8. A barge system as in claim 1 in which spacer blocks are attached to the adjacent barges and the spacer blocks on adjacent barges align and abut with adjacent spacer blocks, whereby the force of application of the wedges causes the spacer blocks to absorb misalignment between the adjacent barges and improve parallel alignment of the adjacent barges.

9. A barge system as in claim 1 in which the adjacent rails include upper rails and lower rails, whereby the first barge is connected to the second barge with the upper rails being situated adjacent and the lower rails being situated adjacent for connection.

10. A barge system as in claim 9 in which each of the connectors includes a vertical post and the connection member includes a U-shaped upper connection member on the top of the vertical post and an inverted U-shaped lower connection member on the bottom of the vertical and the adjacent upper rails are connected by the U-shaped upper connection member and the adjacent lower rails are connected by the inverted U-shaped lower connection member.

11. A method for connecting a pair of adjacent barges comprising the steps of:

a. providing the barge system set forth in claim 1;

b. coupling the adjacent barges by engagement of the adjacent rails to the connection member of at least one of the connectors;

c. inserting the wedge on opposite outward sides of the respective adjacent rails between the wedge block connected on the opposite outward sides of the respective adjacent rails and the connection member, whereby the wedge forcefully engages against the wedge blocks and the connection member for connection of the barges.

* * * * *